US006097671A

United States Patent [19]

Merewether

[11] Patent Number: 6,097,671

[45] Date of Patent: Aug. 1, 2000

[54] PINWHEEL TRANSDUCER ARRAY

[75] Inventor: Ray Merewether, La Jolla, Calif.

[73] Assignee: Rowe-Deines Instruments, San Diego, Calif.

[21] Appl. No.: 09/082,500

[22] Filed: May 21, 1998

[51] Int. Cl.[7] ..... B01S 15/00

[52] U.S. Cl. ..... 367/173; 367/91

[58] Field of Search ..... 367/165, 173, 367/188, 153, 155, 90, 91, 162; 702/143

[56] References Cited

U.S. PATENT DOCUMENTS

| | | | |
|---|---|---|---|
| 5,228,008 | 7/1993 | Burhanpurkar | 367/165 |
| 5,572,487 | 11/1996 | Tims | 367/162 |

OTHER PUBLICATIONS

Kino, Gordon S. (1987) Acoustic waves. Prentice–Hall, Inc. 2:144–150.

Panametrics Transducers (1997) AWS D1.1 Code, OP Angle Beam Transducers & Wedges & AWS Snail Wedges. 4 pages.

Sperry Marine (1995) SRD 421/S 2–Axis Doppler Speed Log. A Speed Log Unequaled in the Industry. 4 pages.

*Primary Examiner*—Daniel T. Pihulic

*Attorney, Agent, or Firm*—Knobbe, Martens, Olson & Bear, LLP

[57] ABSTRACT

An acoustic transducer array in which the transducer elements project a plurality of acoustic beams which are not coplanar. In a first embodiment, a cylindrical transducer array housing has each of four transducer elements skewed at an angle relative to the longitudinal axis of the housing. Each acoustic beam formed by the array lies in a unique plane (e.g., in a "pinwheel" configuration), thereby effectively eliminating overlap of the beams throughout the entire profiling range of the array. In another aspect of the invention, acoustic damping material is incorporated throughout selected portions of the transducer housing to mitigate the effects of echoes and undesirable acoustic propagation within the array.

31 Claims, 10 Drawing Sheets

| | |
|---|---|
| T1=TRANSDUCER 1 | T3=TRANSDUCER 3 |
| T2=TRANSDUCER 2 | T4=TRANSDUCER 4 |

PINWHEEL TRANSDUCER ARRAY

This application claims the benefit of priority in the U.S. Provisional Application No. 60/047,310 filed on May 21, 1997.

BACKGROUND OF THE INVENTION

I. Field of the Invention

The present invention relates to acoustic systems used in fluidic environments. More particularly, the present invention relates to the multi-element transducer arrays of the type typically used in sonar systems.

II. Description of the Related Technology

Multi-element acoustic transducer arrays are useful in a wide variety of sonar system applications, including those used for underwater current profiling and velocity measurement. Additional details regarding the construction and operation of an acoustic Doppler current profiling (ADCP) system are contained in Reissue U.S. Pat. No. 35,535, "Broadband Acoustic Doppler Current Profiler" issued Jun. 17, 1997, incorporated by reference herein in its entirety. Prior art transducer array configurations (such as the Janus configuration of FIG. 1) were designed so that two acoustic beams emitted by two oppositely-positioned transducers were coplanar. Each acoustic beam did not lie in a distinct geometric plane.

In a concave housing plate (e.g., the vessel mount configuration) which is common in the art, the acoustic beams emitted from the transducers cross over after emission at or about the focal region of the plate. The acoustic beams are emitted in a closely packed manner which causes them to interact after emission. For current profiling, the sound energy in the acoustic beams is reflected off of particles in the water and Doppler shift of the echo is used to calculate water velocity. Any particles present within the focal region are ensonified from all directions of emission. The multi-ensonification effect on these particles produces multiple echoes at each transducer. This results in multiple Doppler shift measurements which may be undesirable. To avoid multiple measurements, current profiling does not commence in the vessel mount configuration until after the beam cross over takes place, i.e., beyond the focal region.

An acoustic transducer array configuration is needed which minimizes the acoustic coupling between each beam of the array, thereby increasing its signal-to-noise ratio and overall performance. Such a configuration would also obviate the requirement that profiling be conducted only at ranges greater than the "cross over" distance of the beams in concave configurations.

SUMMARY OF THE INVENTION

The present invention satisfies the aforementioned needs by providing a transducer array configuration, which is useful for underwater acoustic devices including those utilizing the Doppler principle.

In one aspect of the invention, a pinwheel transducer configuration comprises a plurality of transducer elements with their centers equidistantly positioned along a circle (the "transducer circle"). The transducer circle represents a single circle contained in a right cylinder (the "right cylinder"). In an embodiment of the present invention, four transducer elements are utilized in the pinwheel configuration. Each beam emitted by a transducer is constrained to lie in a distinct plane which is tangent to the right cylinder. This configuration minimizes coupling between different beams, since 1) the beams are in separate planes and hence do not cross over, and 2) no conformal hull window such as that used in the prior art is necessary, thereby eliminating cross-coupling of the individual beams due to acoustic reflections from such a window. A compass is optionally integrated into the sensor package of the pinwheel configuration to minimize any adverse effect on the transducers resulting from the rotation about the axis of the transducer circle. The pinwheel transducer may be further configured to transmit the acoustic energy either directly into the water, or indirectly into the water through a block of selected material.

In another aspect of the invention, the pinwheel transducer configuration is modified with selectively applied acoustic damping material. Echoes generated within the transducer housing are spatially and/or spectrally damped by the damping material to increase the signal-to-noise ratio associated with the array, and hence the ultimate performance of the entire sonar system.

Another aspect of the invention includes a sonar system incorporating the pinwheel transducer array. In one embodiment, this sonar system is a broadband Doppler current profiling system.

DETAILED DESCRIPTION OF THE PREFERRED EMBODIMENTS

Reference is now made to the drawings wherein like numerals refer to like parts throughout.

As illustrated in the following description, the pinwheel array configuration of the present invention overcomes the disadvantages and limitations of the prior art. By a unique arrangement of the various transducer elements, the pinwheel configuration unpacks the beams to minimize acoustic coupling between the beams upon emission and receipt. The minimization of such transducer coupling results in profiling measurements having high precision and fine resolution. Furthermore, when using the pinwheel configuration in concave array applications, the requirement of having any beams cross over before commencing the profiling measurements may be eliminated.

In an acoustic Doppler current profiler application, particles carried by the water currents scatter the emitted sonar energy back to a receiver which listens for this echo. Any motion of these particles causes a change in the frequency of the echo. The receiver may form, for example, vertical profiles by assigning different water depths to corresponding parts of the echo record. Moreover, the receiver detects any change in such frequency, i.e., the Doppler shift, as a function of the depth of the object to obtain water velocity. In an exemplary application, the pinwheel configuration may be mounted on a moving ship to measure the velocity of the ship (relative to a dock) on its approach to the dock. Hence, the resulting pinwheel configuration achieves remote profiling of currents, suspended materials, and velocities of moving vessels in water. The transducer configuration can either be mounted in moving vessels or stationary platforms.

Figure 1:
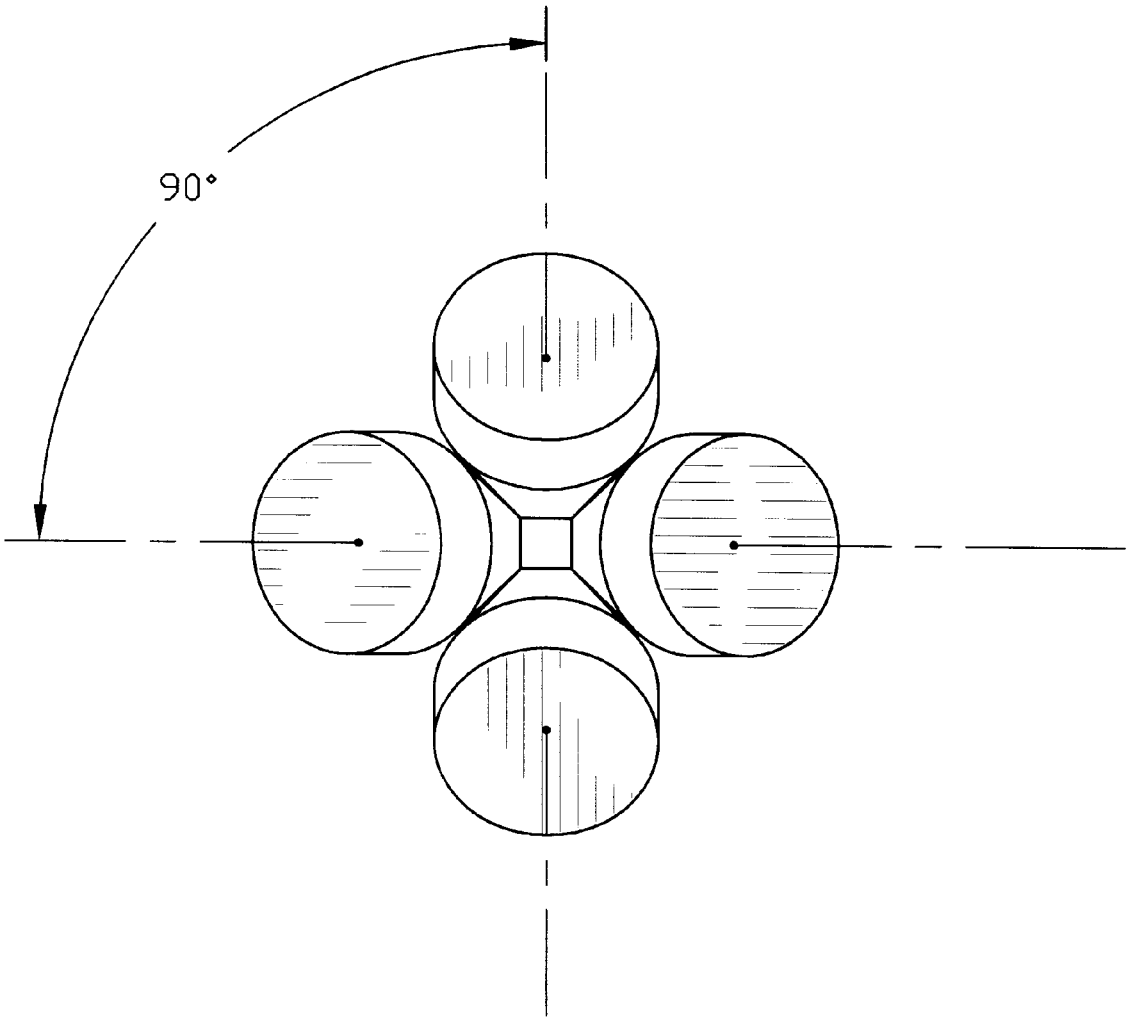
FIG. 1 (PRIOR ART)
FIG. 1 is a top plan view of a prior art Janus configuration transducer array showing the coplanarity of pairs of opposite transducer elements.
Figure 2:
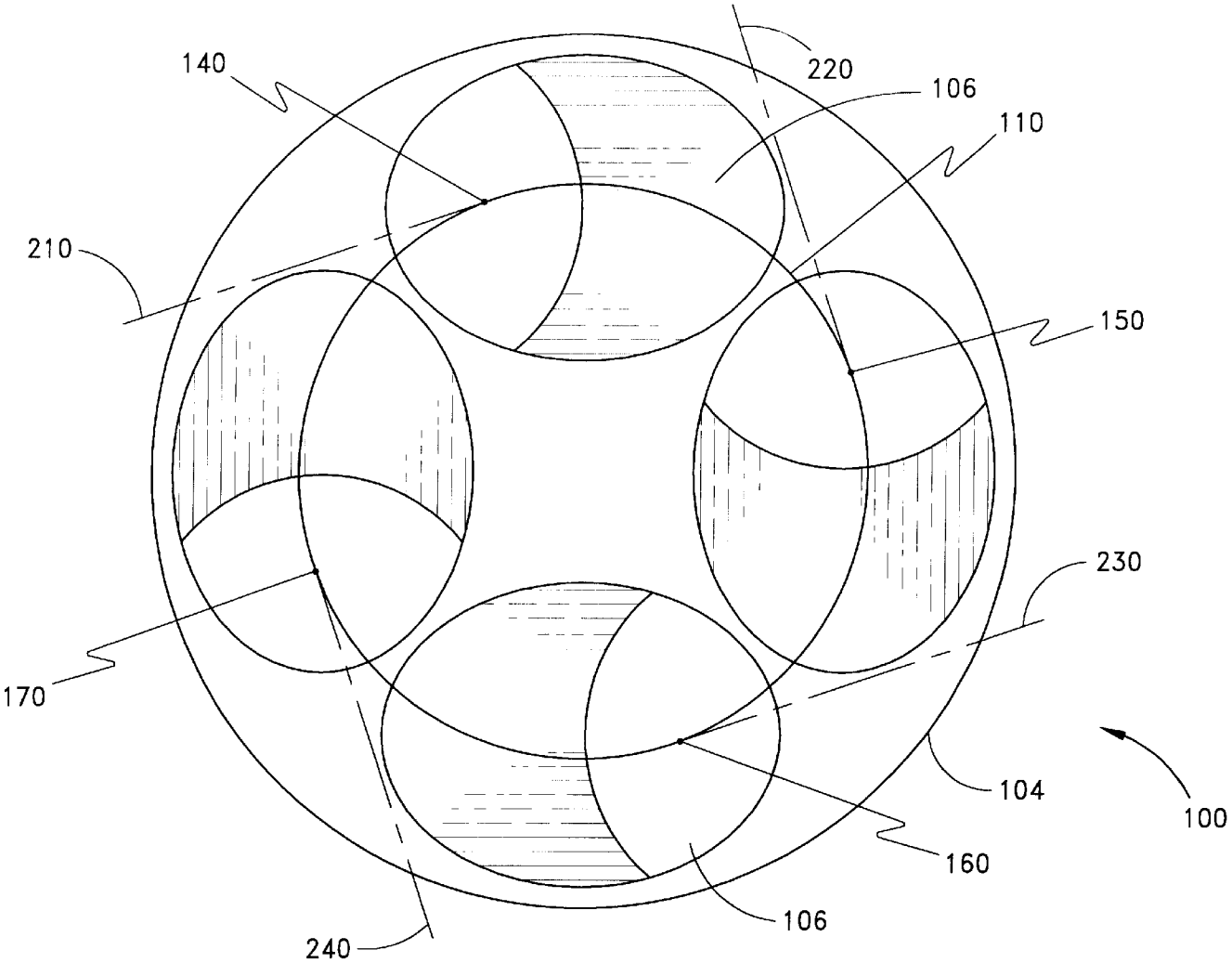
FIG. 2 is a top plan view of a first embodiment of the transducer array housing of the present invention, with recesses for receiving four acoustic transducer elements.
Figure 3:
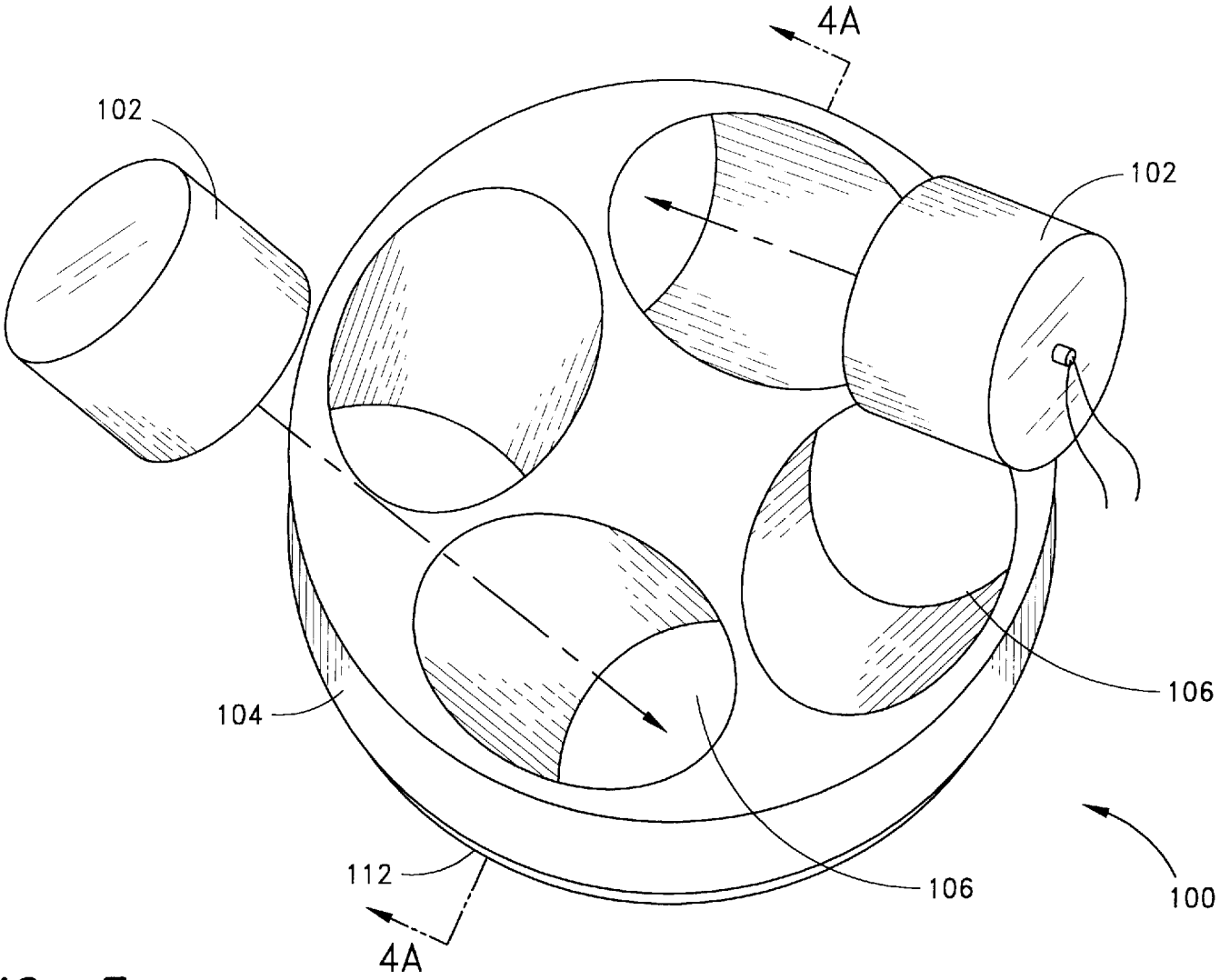
FIG. 3 is a side perspective view of the transducer array housing of FIG. 2, showing the relative placement of the individual transducer elements.

Referring now to FIGS. 2 and 3, a first embodiment of the pinwheel transducer array 100 of the present invention is shown. This embodiment incorporates a plurality of cylindrical transducer elements 102 (FIG. 3) located within a cylindrical transducer housing 104. The transducer elements 102 may be of the piezoelectric (ceramic) type well known in the art, although other types of elements may be used. Four transducer elements are placed within an equal number of recesses 106 within the transducer housing 104. The four transducer elements 102 are positioned within the recesses in such a manner that their geometric centers (i.e. 140, 150, 160, 170) are equidistant and lie on the same circle 110 (the "transducer circle"). The transducer circle represents a single circle contained in a right cylinder (the "right cylinder"; not shown in FIG. 2 or 3). In the illustrated embodiment, the plane containing the transducer circle 110 is also parallel to the bottom face 112 of the housing. Each recess 106 in the transducer housing 104 is also generally cylindrical in shape and sized to receive a respective transducer element 102, although other quantities, shapes, sizes, and orientations of recess (and transducer element) are possible. See, for example, the embodiments of FIGS. 7 and 8, which are described in further detail below.

While the embodiment of the array 100 shown in FIG. 2 utilizes a cylindrical housing 104, other housing forms and cross-sectional shapes (such as elliptical, square, spherical, etc.) are possible.

Figure 4A:
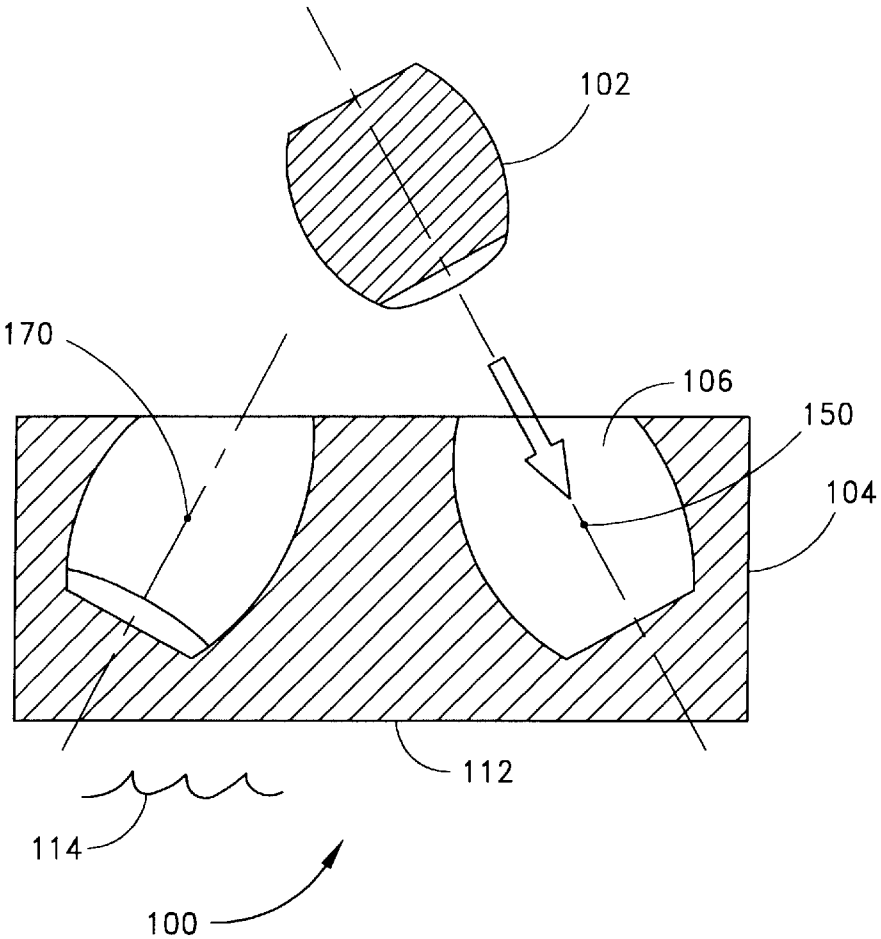
FIG. 4*a* is a cross-sectional view of the transducer array of FIG. 3, taken along line 4*a*—4*a*.

Referring now to FIG. 4*a,* a cross-sectional view of the transducer array 100 of FIGS. 2 and 3 is shown. The housing 104 has a planar bottom face 112 which acts as the interface of the transducer array 100 with the fluidic environment 114. Note that the shape of the bottom face 112 may be altered (such as being made convex or concave) based on the desired acoustic properties. For example, a convex or concave bottom face may be used to modify the shape and dispersion of the acoustic beams.

In a typical application of the array 100 in a sonar system, each transducer element 102 in the array 100 emits a beam of acoustic energy into the fluid medium 114. The acoustic energy is generally emitted in the form of a narrowband (e.g., pulsed tone) or wideband (e.g., multi-pulse phase-modulated) signal. The frequency of such narrowband or wideband signal is preferably centered around the transducer element's resonant frequency.

Figure 4B:
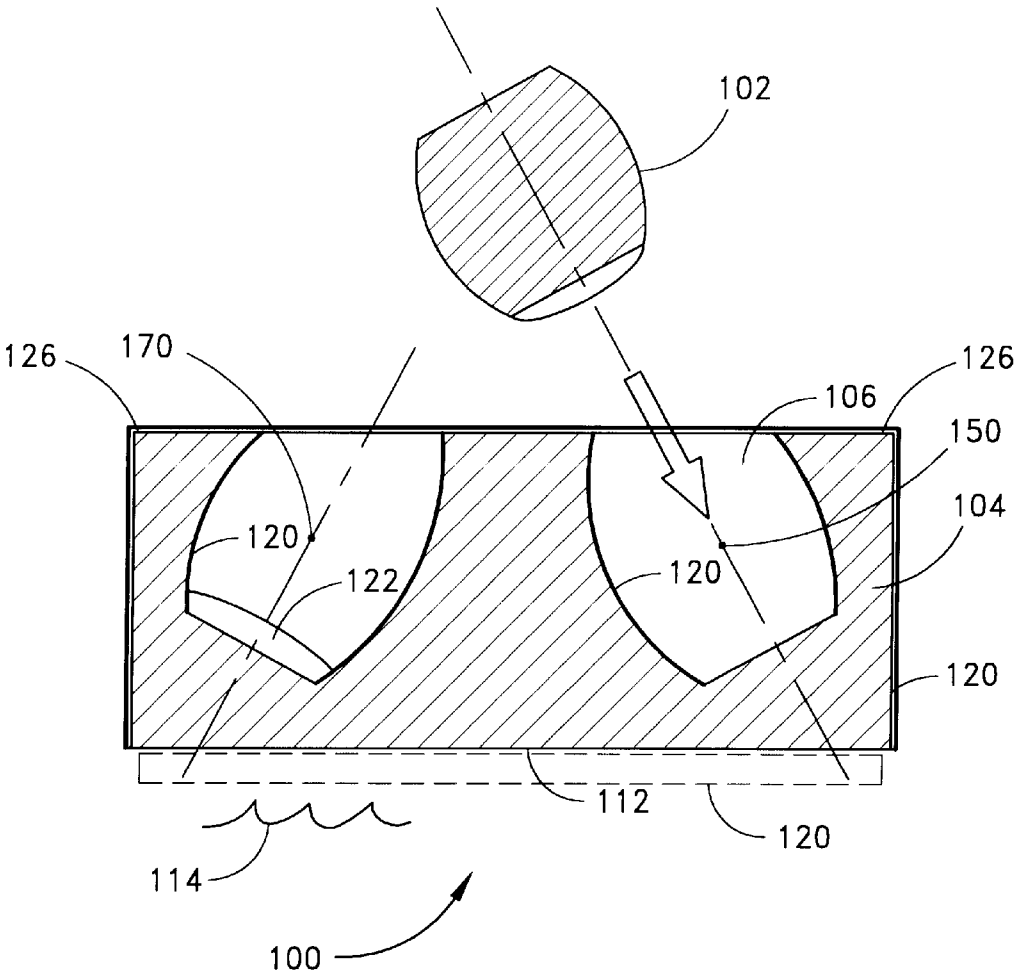
FIG. 4*b* is a cross-sectional view of the transducer array of FIG. 3, taken along line 4*a*—4*a* with attached acoustic damping material.

FIG. 4*b* shows a cross-sectional view of the transducer array 100 of FIGS. 2 and 3, with optional acoustic damping material 120 added to selected portions of the transducer housing 104. This material 120 is used to attenuate echoes created within the transducer housing 104 caused by unwanted wave propagation, as well as reduce the coupling between different transducer elements 102. High-loss damping material 120 is placed generally on surfaces other than the housing-to-transducer forward interface 122 and the array bottom face 112. It should be noted however that under certain circumstances, it may be desirable to place low-loss damping material 120 with specific acoustic characteristics on the bottom face 112 or forward interface 122, as indicated by the dashed lines in FIG. 4*b*. For example, a thin layer of damping material on the bottom face may be useful to attenuate turbulent flow noise present in the water. Alternatively, the presence of damping (commonly referred to as "matching") material of a specific thickness can constructively or destructively interfere as desired with certain wavelengths of energy radiated from the transducer elements 102 so as to attenuate or enhance certain frequency bands. Finally, the presence of acoustic damping material on certain regions of the bottom face 112 may effectively act as an acoustic aperture for the beams emitted from the transducer elements.

The damping material 120 shown in FIG. 4*b* is fabricated from a heterogeneous mixture of lead and soft urethane in the present embodiment, although other materials with desirable acoustic and physical properties such as neoprene, acrylics, or epoxies may be substituted. Considerations for selecting an adequate damping material may include its longevity in an aqueous environment, physical attributes (such as density, anisotropy, plane wave moduli, shear wave moduli, and toughness), and its ability to effectively attenuate various frequencies or transmission modes.

Furthermore, the present invention may make the use of different types of acoustic damping material in various locations on the array housing 104. For example, one type of material which is highly water resistant, such as hard urethane (Shore D 50 hardness typically), may be used on the planar bottom face 112 of the array for damping echoes incident upon the array, while another non-water-resistant material, such as soft urethane or epoxy (Shore A 40 to 80 typically), with other desirable properties may be used in portions of the array not exposed to water.

Figure 5:
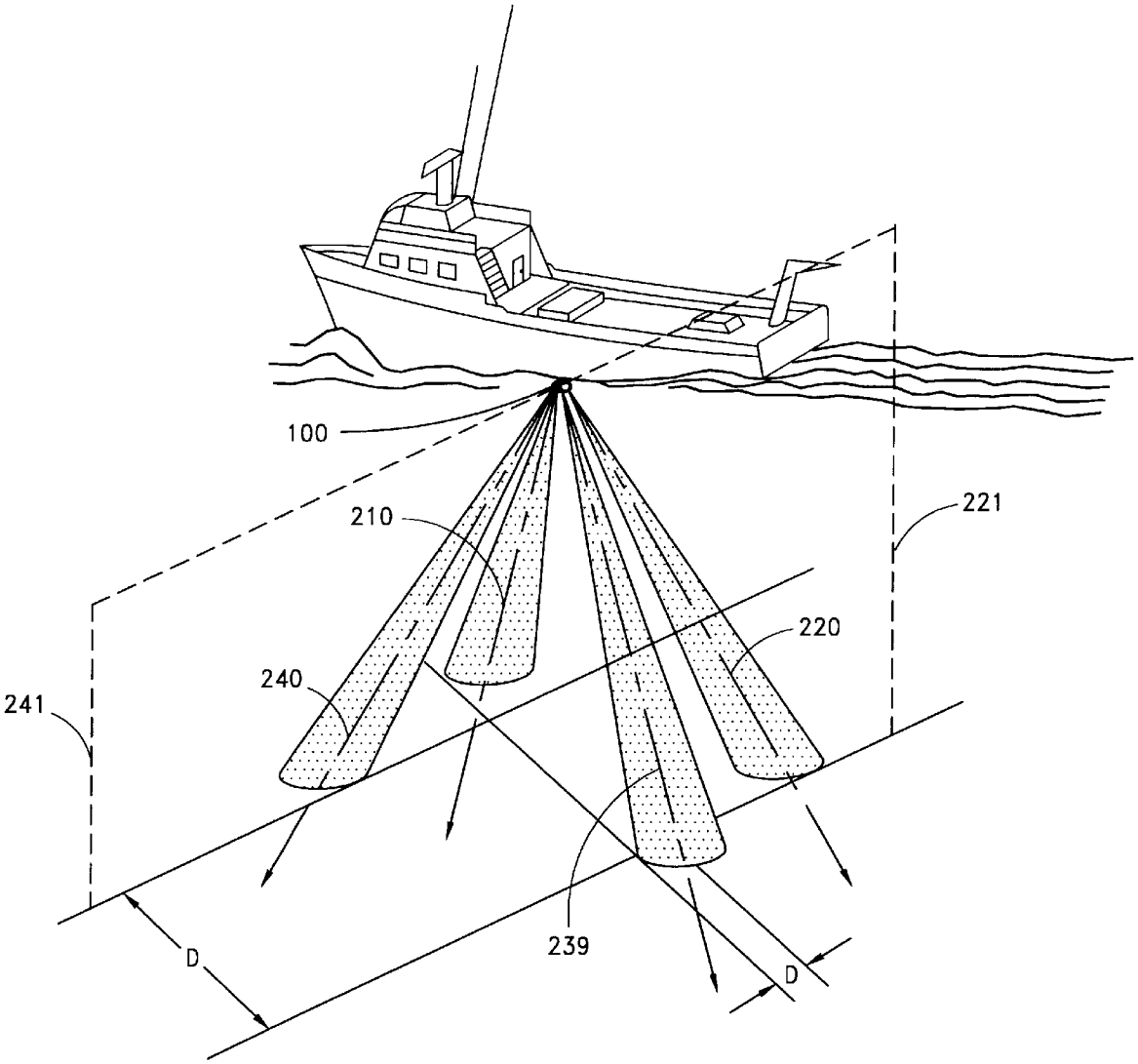
FIG. 5 shows an exemplary acoustic spatial propagation of four beams forming four distinct planes defined by a linear conic section made through each beam axis using the pinwheel transducer array of FIG. 3.

Referring again to the embodiment of FIG. 4*b*, the damping material 120 is bonded directly to the array housing using any number of conventional adhesives 126 or bonding agents such as 416 Super Bonder manufactured by Loctite Corporation, or otherwise incorporated via a prefabricated constrained layer damper. Alternatively, the damping material may be conformally molded within the housing 104 in discrete pieces upon the housing's manufacture, mechanically fastened to the housing, or even blended into the polymer formulation used to fabricate the housing. For example, certain subsections of the housing itself may be fabricated using damping material or another material which incorporates damping material; these subsections can then be bonded or attached to other non-damping subsections to form a unitary assembly having the desired acoustic properties. FIG. 5 shows an exemplary spatial acoustic propagation of the four emitted acoustic beams 210, 220, 230, and 240, using the pinwheel transducer array 100 of the linear conic section made through the axis of the present invention.

The four transducer elements 102 are positioned so that the beam emitted by each element is constrained to lie in a plane tangent to the right cylinder 130 (shown in FIG. 5). To illustrate this design characteristic, it is preferable that the two opposite acoustic beams 220 and 240 be "skewed" or inclined in a manner so that each beam lies in a distinct plane which is geometrically tangential to the right cylinder 130. A plane 221 is shown to contain the axis of the acoustic beam 220 in FIG. 5. Another plane 241 is shown to contain the axis of the acoustic beam 240. Hence, the plane 221 is parallel to plane 241. Since the beam axes are not coplanar and the coupling between beams is minimized, use of the pinwheel configuration of the present invention eliminates the requirement of having the beams cross over before profiling measurements begin.

Additionally, an electronic or mechanical compass, the construction of each being well known in the art, may be integrated into the sensor package of the pinwheel transducer array to measure and remove the velocities attributable to the transducer's rotation about the axis 121 (shown in FIG. 6) intersecting the center of the transducer circle 110. Alternatively, the effects of rotation around the axis 121 can be compensated for by orienting two of the transducer elements 102 (and their resulting acoustic beams) in a clockwise direction, and two in a counter-clockwise direction. In this fashion, the rotational effects on the velocity measurements obtained via the clockwise oriented beams are canceled by those associated with the counter-clockwise oriented beams.

Figure 6:
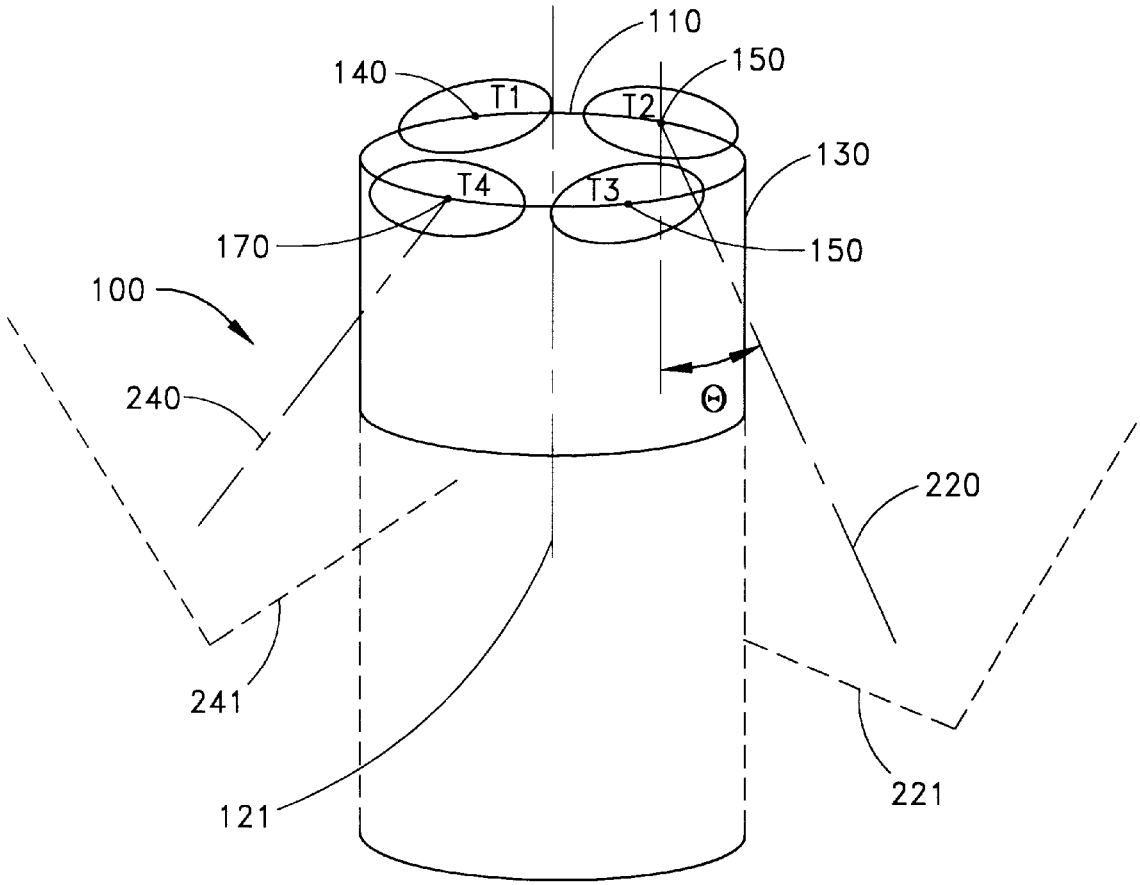
FIG. 6 shows the propagation axis of acoustic beams in relation to the right cylinder of the transducer array of FIG. 3.

FIG. 6 more clearly illustrates the propagation of the acoustic beams in relation to the right cylinder 130 of the present embodiment. The right cylinder 130 contains the same axis 121 of the transducer circle 110. Note that the right cylinder 130 is a conceptual three-dimensional space which is useful to illustrate the relative locations of the acoustic beams. Typically, each transducer is positioned in the housing 104 with an inclination angle (Θ). The inclination angle Θ is the angle formed between the axis 121 and the sensitive axis of the transducer (e.g., the central direction of the emitted beam 220). In the present embodiment, the inclination angle Θ is typically in the range of 20–50 degrees, but is preferably about 45 degrees. Other angles may be used depending on the depth, resolution, or form of the desired measurements. For instance, in the case that the acoustic beam 220 is transmitted directly into the water (see discussion of FIG. 7 below) as opposed to be transmitted through the bottom face of the housing, the inclination angle Θ is preferably around 25–30 degrees. As shown in FIG. 6, the acoustic beam 220 is emitted from transducer element T2, and another acoustic beam 240 is emitted from the transducer element T4, and so forth. As explained above, the acoustic beam 220 lies in the geometric plane 221 which is tangential to the right cylinder 130. The geometric plane 221 intersects the right cylinder 130 at a straight line whereby the center 150 of the transducer element T2 constitutes a point on that straight line. Similarly, the acoustic beam 240 lies in the geometric plane 241 which is tangential to the right cylinder 130. The geometric plane 241 intersects the right cylinder 130 at a straight line whereby the center 170 of transducer element T4 constitutes a point on that straight line.

Figure 7:
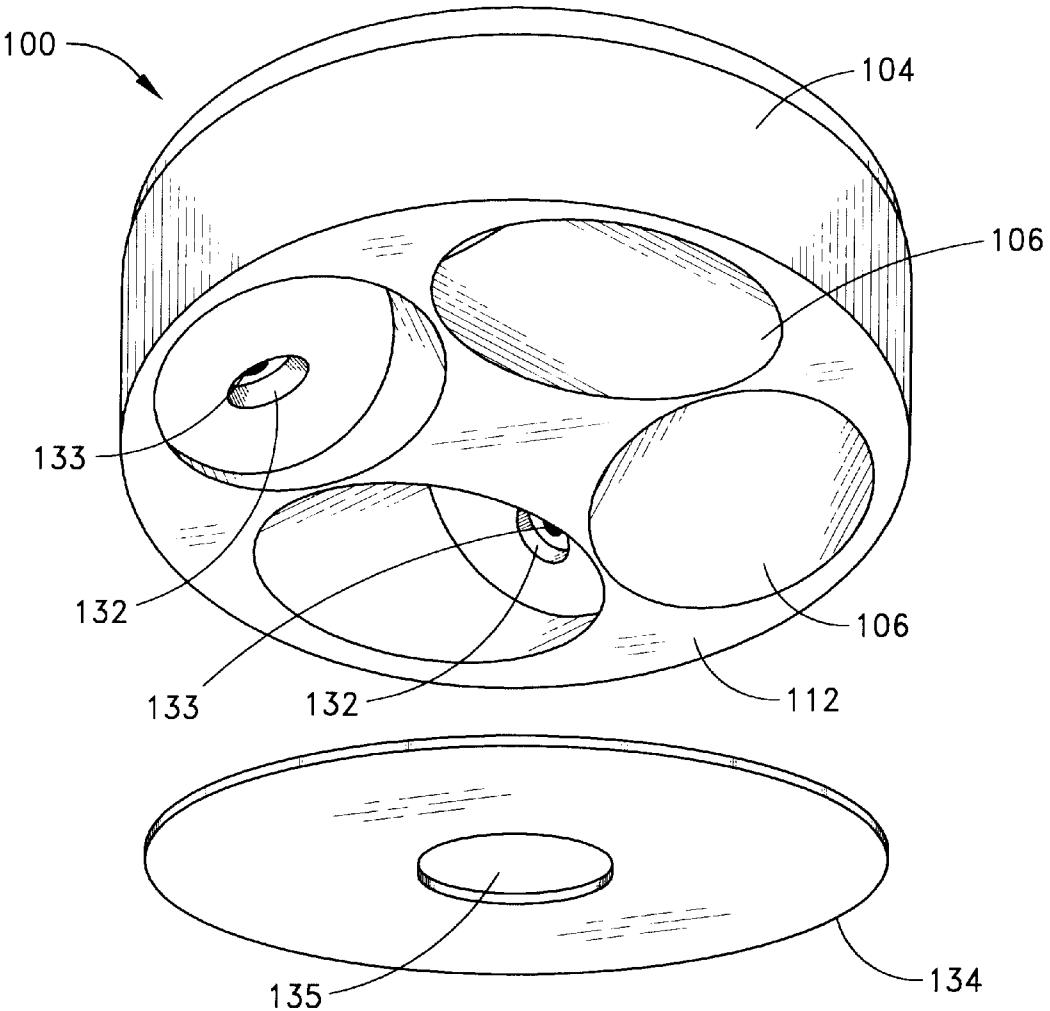
FIG. 7 is a bottom perspective view of another embodiment of the transducer housing of the present invention, with recesses for receiving four acoustic transducers and their associated transformers.

FIG. 7 shows a second embodiment of the transducer array of the present invention. Similar to the embodiment described above, the transducer array of FIG. 7 utilizes a right cylindrical polymeric housing 104 and plurality of individual transducer elements 102 (FIG. 3). However, the transducer recesses 106 in this second embodiment are in an inverted orientation to those of the first embodiment such that the transducer elements and, therefore, the acoustic beams project downward at an angle from the housing 104. Smaller secondary recesses 132 are formed above the transducer element recesses 106 to receive transformers or other devices associated with each of the transducer elements 102. These secondary recesses 132 are generally smaller in diameter than the transducer element recesses 106, and may be offset (e.g., eccentric) to the element recesses. Additionally, wiring penetrations 133 are provided which allow wiring to pass through the top surface of the housing into the secondary recesses 132. An aperture plate 134 with an aperture 135 is optionally placed over the bottom face of the housing 112 if desired to form an aperture for the array, as shown in FIG. 7.

Figure 8:
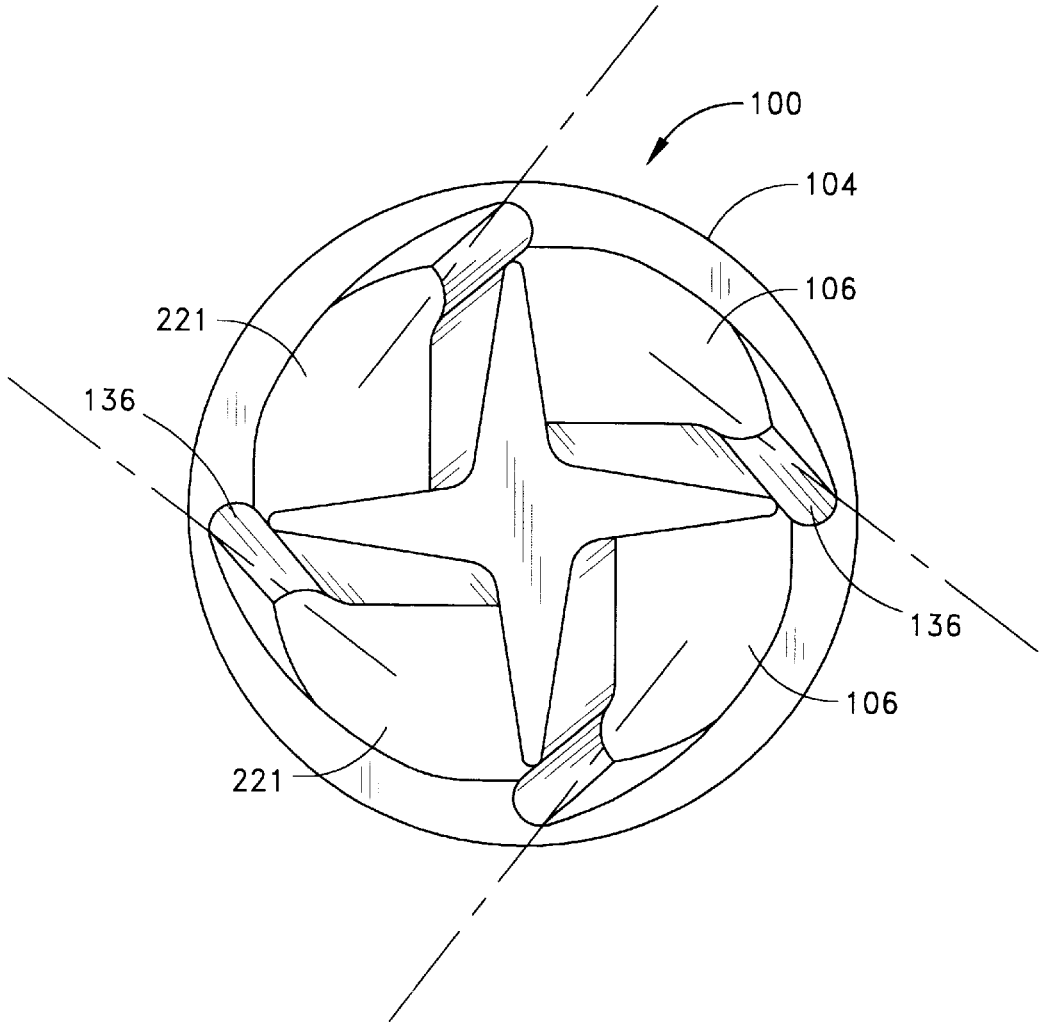
FIG. 8 is a top plan view of another embodiment of the transducer housing of the present invention, with recesses for receiving four acoustic transducers having maximized surface area.

FIG. 8 shows a third embodiment of the transducer array of the present invention. This embodiment is generally similar to that shown in FIGS. 2 through 4, with the exception that the transducer element recesses 106 within the housing are of irregular shape so as to provide the maximum transducer face surface area possible. Specifically, the recesses 106 are substantially square in cross-section with additional cavities 136 formed within the housing and adjacent to the recesses 106 to receive components relate to the transducer elements 102. Note that the placement, shape and orientation of these cavities 136 may be varied to suit the needs of a given application. Using this arrangement, a greater surface area is available to the transducer elements 102 installed in the recesses 106 for the transmission/reception of acoustic energy. In the present embodiment, transducer elements of non-circular cross-section (such as quarter circle, or irregular quadrilateral) are employed to make maximum use of the available surface area.

Figure 9:
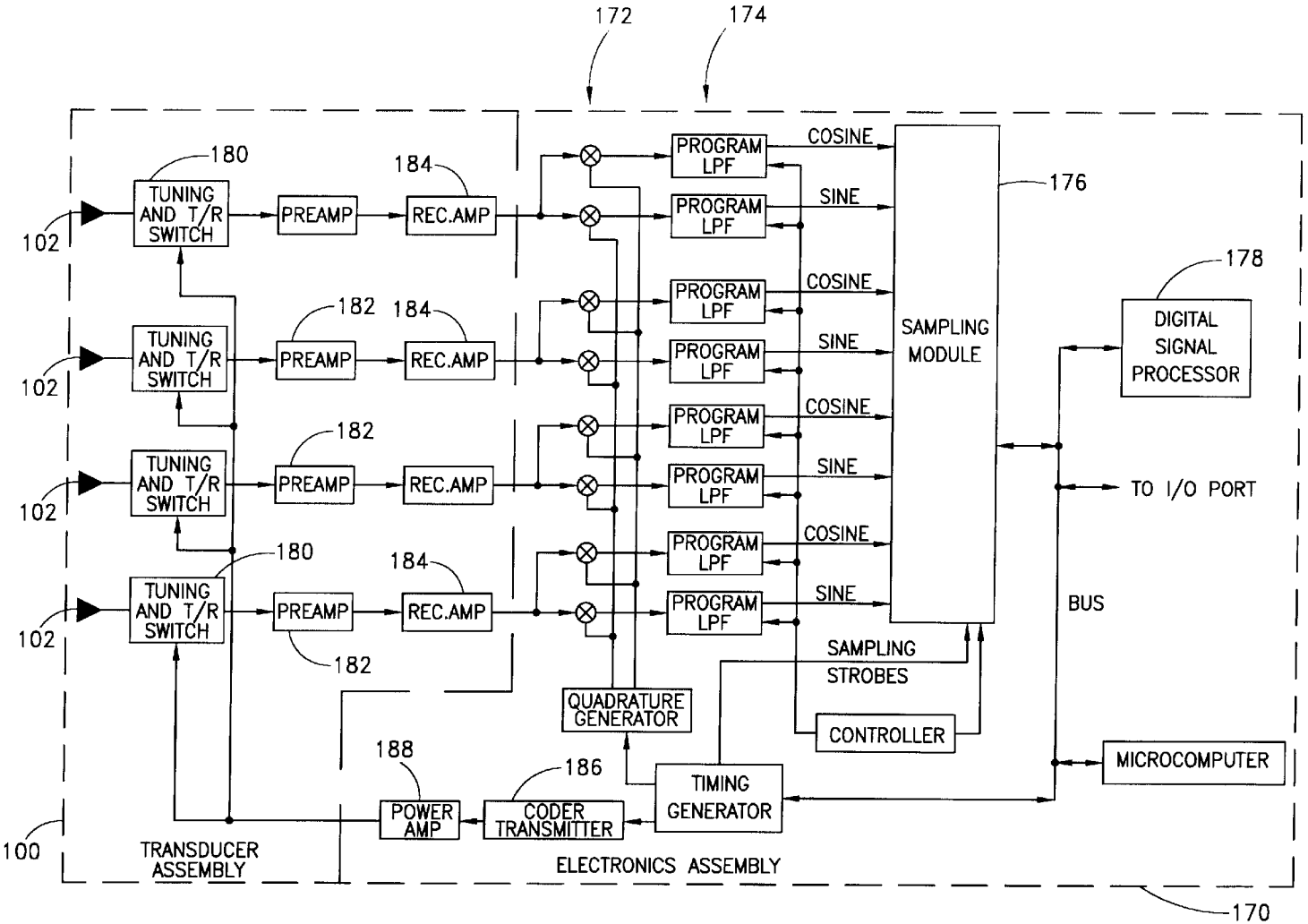
FIG. 9 is a functional block diagram of an embodiment of a sonar system utilizing the transducer array of the present invention.

Referring now to FIG. 9, an exemplary sonar system utilizing the transducer array of the present invention is shown. Specifically, FIG. 9 depicts the transducer array 100 used in conjunction with a broadband acoustic doppler current profiler (ADCP) system such as a Rowe Deines Instruments Model BBADCP VM-150. While the following discussion describes the aforementioned ADCP system, it can be appreciated that other models and types of sonar systems (such as narrowband systems) may be used with the transducer array of the present invention depending on the particular application and needs of the user.

Referring again to FIG. 9, the transducer array 100 is electrically connected to the electronics assembly 170 which includes a mixer network 172, low pass filter network 174, sampling module 176, and digital signal processor (DSP) 178. Signals generated by the transducer array elements 102 upon the receipt of acoustic signals are fed (via the transmit/receive switches 180) to preamplifiers 182 and receiver amplifiers 184 which condition and amplify the signal(s) for further processing by the electronics assembly 170. A coder transmitter 186 and power amplifier 188 are used in conjunction with the DSP 178 to feed transmission signals to the transducer elements 102 via the transmit/receive switches 180. Thus, the same transducer elements are used for both transmit and receive functions.

While the above detailed description has shown, described, and pointed out fundamental novel features of the invention as applied to various embodiments, it will be understood that various omissions, substitutions, and changes in the form and details of the devices illustrated may be made by those skilled in the art without departing from the spirit of the invention.

What is claimed is:

1. An acoustic transducer array, comprising:

a housing having a first surface;

a plurality of acoustic transducer elements;

a plurality of recesses formed within said housing, said recesses further sized to receive respective ones of said transducer elements, wherein said recesses are inclined with respect to said first surface such that none of the acoustic beams emitted from respective ones of said transducer elements are coplanar.

2. The transducer array of claim 1, wherein said first surface of said housing is a flat plane.

3. The transducer array of claim 1, wherein said housing has a substantially circular cross-sectional shape.

4. The transducer array of claim 3, wherein said housing is a right circular cylinder.

5. The transducer array of claim 4, wherein said recesses and said transducer elements are inclined at an angle of between 20 and 30 degrees in relation to the longitudinal axis of said right cylinder.

6. The transducer array of claim 1, wherein said first surface of said housing is convex.

7. The transducer array of claim 1, wherein the longitudinal axis of each of said recesses is contained within a plane tangent to a circle and wherein said circle is substantially parallel to said first surface.

8. The transducer array of claim 1, wherein said array further includes acoustic damping material applied to selective portions of said housing.

9. The transducer array of claim 1, wherein said transducer elements are piezoelectric transducers.

10. The transducer array of claim 1, wherein said housing is composed at least in part of a polymer.

11. An acoustic transducer array, comprising:

a plurality of acoustic transducer elements;

a housing having a substantially planar surface;

a plurality of recesses formed within said housing and sized to receive respective ones of said transducer elements, each of said recesses further having a longitudinal axis oriented with respect to said substantially planar surface such that none of the acoustic beams formed by said transducer elements are coplanar.

12. The transducer array of claim 11, wherein said housing is a right circular cylinder.

13. The transducer array of claim 12, wherein the longitudinal axis of each of said recesses is contained within a plane tangent to a circle and wherein said circle is substantially parallel to said planar surface.

14. The transducer array of claim 11, wherein said array further includes acoustic damping material applied to selective portions of said housing.

15. A sonar system, comprising:

a pulse generator for generating a plurality of pulses;

a pinwheel transducer array operably connected to said pulse generator for transmitting said plurality of pulses and receiving resulting echoes;

a sampling circuit for sampling said echoes received by said transducer array; and a processor operably connected to said sampling circuit for analyzing said echoes.

16. The sonar system of claim 15, wherein said system is a Doppler current profiling system.

17. The sonar system of claim 15, wherein said pulses are coded pulses of preselected length separated by a time lag.

18. The sonar system of claim 15, wherein said sampling circuit samples quadtrature components of a received signal over a time interval.

19. The sonar system of claim 15, wherein said processor includes means for obtaining a velocity measurement based on autocorrelation.

20. The sonar system of claim 19, wherein said means for obtaining a velocity measurement based on said autocorrelation is an algorithm.

21. An acoustic transducer array, comprising:

a housing having a first surface and a substantially circular cross-sectional shape;

a plurality of acoustic transducer elements;

a plurality of recesses formed within said housing, said recesses further sized to receive respective ones of said transducer elements, wherein said recesses are inclined with respect to said first surface such that at least two acoustic beams emitted from respective ones of said transducer elements are not coplanar.

22. The transducer array of claim 21, wherein said housing is a right circular cylinder.

23. The transducer array of claim 22, wherein said recesses and said transducer elements are inclined at an angle of between 20 and 30 degrees in relation to the longitudinal axis of said right cylinder.

24. An acoustic transducer array, comprising:

a housing having a convex first surface;

a plurality of acoustic transducer elements;

a plurality of recesses formed within said housing, said recesses further sized to receive respective ones of said transducer elements, wherein said recesses are inclined with respect to said first surface such that at least two acoustic beams emitted from respective ones of said transducer elements are not coplanar.

25. An acoustic transducer array, comprising:

a plurality of acoustic transducer elements;

a housing having a substantially planar surface and a right cylindrical shape;

a plurality of recesses formed within said housing and sized to receive respective ones of said transducer elements, each of said recesses further having a longitudinal axis oriented with respect to said substantially planar surface such that at least two acoustic beams formed by said transducer elements are not coplanar.

26. The transducer array of claim 25, wherein the longitudinal axis of each of said recesses is contained within a plane tangent to a circle and wherein said circle is substantially parallel to said planar surface.

27. An acoustic transducer array, comprising:

a housing having a first surface;

at least first and second acoustic transducer elements;

at least two recesses formed within said housing, said at least two recesses being diametrically opposed to one another and further sized to receive respective ones of said at least first and second transducer elements, wherein said recesses are inclined with respect to said first surface such that the acoustic projection from said first acoustic transducer element lies in a plane parallel to the plane of the acoustic projection from said second acoustic transducer element, and said first and second acoustic projections do not cross over each other in the near field.

28. The acoustic array of claim 27, further comprising:

third and fourth acoustic transducer elements, and third and fourth recesses being diametrically opposed to one another and sized to receive respective ones of said third and fourth transducer elements, wherein said third and fourth recesses are inclined with respect to said first surface such that the acoustic projection from said third acoustic transducer element lies in a plane parallel to the plane of the acoustic projection from said fourth acoustic transducer element;

wherein the acoustic projections from said first, second, third, and fourth acoustic transducer elements do not cross over one another in the near field.

29. The acoustic array of claim 28, wherein said planes associated with said acoustic projections from said third and fourth transducer elements are perpendicular to said planes associated with said acoustic projections form said first and second transducers.

30. An acoustic transducer array, comprising:

a housing having a first surface;

at least first and second acoustic transducer elements; and at least two recesses formed within said housing, said at least two recesses having a first angular relationship to one another and further sized to receive respective ones of said at least first and second transducer elements, wherein said recesses are inclined with respect to said first surface such that the acoustic projection from said first acoustic transducer element lies in a plane having a second angular relationship with the plane of the acoustic projection from said second acoustic transducer element such that said first and second acoustic projections do not cross over each other in the near field.

31. The acoustic array of claim 30, wherein said first angular relationship is identical to said second angular relationship.

* * * * *